US005694709A

United States Patent [19]

Cronk, Jr. et al.

[11] Patent Number: 5,694,709

[45] Date of Patent: Dec. 9, 1997

[54] PIPELINE PADDING MACHINE WITH CRUSHER

[76] Inventors: Thomas J. Cronk, Jr., P.O. Box 11189, Odessa, Tex. 79760; Ray E. Hudson, 14009 County Rd., 123, West Odessa, Tex. 79765

[21] Appl. No.: 374,419

[22] Filed: Jan. 19, 1995

[51] Int. Cl.[6] ..... E02F 5/22

[52] U.S. Cl. ..... 37/142.5; 405/179; 241/230

[58] Field of Search ..... 37/142.5; 405/179; 171/4, 24, 114, 116; 404/91; 241/230, 231, 227, DIG. 38

[56] References Cited

U.S. PATENT DOCUMENTS

| | | | |
|---|---|---|---|
| 2,618,439 | 11/1952 | Malone | 241/230 |
| 2,843,330 | 7/1958 | Gundlach | 241/230 |
| 2,879,952 | 3/1959 | Pollitz et al. | 241/230 |
| 3,190,571 | 6/1965 | Kimball | 241/230 |
| 3,199,798 | 8/1965 | Turner, Jr. | 241/230 |
| 3,478,972 | 11/1969 | Hansen | 241/230 |
| 3,596,384 | 8/1971 | Neujahr | 37/142.5 |
| 3,647,150 | 3/1972 | Stephanek | 241/230 X |
| 3,701,422 | 10/1972 | Downey | 37/142.5 X |
| 3,984,151 | 10/1976 | Altmayer | 241/231 X |
| 4,192,471 | 3/1980 | Beckman et al. | 241/227 X |
| 4,588,033 | 5/1986 | Orthman | 171/24 X |
| 4,633,602 | 1/1987 | Layh et al. | 37/142.5 X |
| 4,861,461 | 8/1989 | Utterback | 37/142.5 X |
| 4,912,862 | 4/1990 | Bishop et al. | 37/142.5 |
| 4,948,299 | 8/1990 | Cronk et al. | 405/179 |
| 4,955,756 | 9/1990 | Klamar | 405/179 |
| 5,084,991 | 2/1992 | Cronk, Jr. | 37/142.5 |
| 5,097,610 | 3/1992 | Bishop | 37/142.5 |
| 5,120,433 | 6/1992 | Osadchuk | 209/235 |
| 5,154,364 | 10/1992 | Ketting | 241/230 X |
| 5,242,246 | 9/1993 | Manchak, III et al. | 37/142.5 X |
| 5,245,768 | 9/1993 | Purkeypile | 37/347 |
| 5,259,699 | 11/1993 | Klamar | 37/142.5 X |
| 5,261,171 | 11/1993 | Bishop | 37/142.5 |
| 5,445,330 | 8/1995 | Shokry Rashwan et al. | 241/DIG. 38 |

FOREIGN PATENT DOCUMENTS

| | | | |
|---|---|---|---|
| 356028948 | 3/1981 | Japan | 37/318 |

*Primary Examiner*—Terry Lee Melius
*Assistant Examiner*—Thomas A. Beach
*Attorney, Agent, or Firm*—Arnold, White & Durkee

[57] ABSTRACT

A pipeline padding machine is provided comprising a crushing mechanism for crushing large pieces of excavated material into smaller pieces of material that are suitable for use in padding a pipeline or underground cable. In preferred embodiments, the crusher comprises two parallel rollers that are arranged with a selected gap between them. The rollers are driven toward each other, such that excavated material that is fed onto the rollers is drawn into the gap, and pieces that are too large to fall through the gap are crushed by the rollers. The crusher mechanism may be installed on a known type of padding machine, preferably at the end of the transverse conveyor over the trench. Alternatively, the crusher may be mounted on the padding machine frame. The output material from the crusher may be screened or otherwise processed, or it may be delivered directly to the trench.

10 Claims, 8 Drawing Sheets

PIPELINE PADDING MACHINE WITH CRUSHER

BACKGROUND OF THE INVENTION

The present invention relates to earth moving and handling machinery, and more particularly to machinery for preparing and depositing padding material in a trench during installation of a pipeline or underground cable.

An underground pipelines or cable is generally installed by placing it in a prepared trench and then filling the trench to cover the pipeline or cable and to restore the surface of the ground to the desired condition. Pipelines often have coatings for corrosion control that are subject to damage by rocks and other hard or sharp objects. Pipelines exhibit some amount of motion with respect to the surrounding soil after they are installed, primarily due to thermal expansion and contraction, and they must be protected from direct contact with rocks and other hard or sharp objects than may cause damage both during and after installation. Buried cables, including fiber optic cables, are also susceptible to damage if not properly padded by fine or soft material. It is therefore often desirable to place a layer of sand or soil that is free of large rocks and other undesirable material in the trench immediately adjacent a pipeline or cable to provide uniform support and to protect the pipeline or cable from damage caused by rocks and other objects. In many applications two layers of padding are required, one below the pipe and another above the pipe, so that the pipeline is completely surrounded by padding material.

Although this patent specification will refer primarily to the use of the present invention with respect to installation pipelines, it is to be understood that the invention is equally applicable for use in installation and repair of underground cables.

The sand or soil that is used to pad pipelines or cables is called padding material. Padding material may be hauled to the trench from a remote location. This is a difficult and expensive way to provide padding material, because a source of material must be identified and then the material must be purchased, hauled to the pipeline site, and properly deposited around the pipe. Furthermore, there are other disadvantages to using non-native soil for padding material that are know in the art, including increased problems with corrosion under some circumstances.

Alternatively, padding material may be produced or selected from the excavated material that is removed from the pipeline trench when it is dug. Typically, when a pipeline trench is excavated the removed material, including soil and rocks, is deposited along one side of the trench. That material may be screened or sorted to separate the rocks from the fines, and the fines may be collected and used for padding material. After the fines are placed around the pipe, the remainder of the unsorted excavated material, including larger rocks that are not suitable for padding material, may be placed in the trench to fill it to grade level.

A number of integrated pipe padding machines have been developed for picking up excavated material from alongside a pipeline trench, sorting it into padding material and residual material, and placing the padding material into the trench. These machines typically employ a transverse conveyor that extends to a position over the trench for carrying the padding material from a separator mechanism in the machine to the trench. The following U.S. Patents illustrate and describe such machines: 4,633,602; 4,912,862; 4,948,299; 5,084,991; 5,097,610; 5,120,433 and 5,261,171. The disclosure of each of those patents is hereby incorporated into this application by reference.

The separating and padding machines known in the prior art, including those described in the above-referenced patents, rely on screening or sifting means for separating padding material from residual excavated material. Under some circumstances it is difficult or impossible to efficiently generate an adequate quantity of padding material from the material removed from the trench using such means. In very rocky conditions, there may not be enough soil and other fine material in the excavated material. In wet conditions or in areas with high clay content, the soil may tend to clump and not pass through the screen of the padding machine. Sometimes it may be necessary to use a larger screen size than desired in order to produce a required mount of padding material under particular circumstances. Pipeline constructors typically specify the maximum particle size that is acceptable in the padding material, and using larger screen sizes may not be acceptable to the owner of the pipeline. It is therefore desirable to provide a more active method of producing padding material from various types of excavated material so as to be assured of an adequate supply of padding material that can be predictably and efficiently manufactured at the pipeline site from the native materials removed from the trench.

SUMMARY OF THE INVENTION

The present invention provides an active means for producing padding material from excavated material, regardless of whether the excavated material initially contains sufficient fine material suitable for padding. The present invention also permits the padding machine operator to preselect the size (degree of fineness) of the padding material that is to be produced for a particular job, regardless of the condition of the excavated material that is generated when the trench is dug.

The present invention comprises a crushing mechanism that may be added to an integrated padding machine to replace or supplement the screening means that are shown by the prior art. Alternatively, the crushing mechanism of the present invention may be attached to an excavating machine for producing padding material while the trench is being dug, or the crushing mechanism may be used independently of an excavating or padding machine. In presently preferred embodiments, the crushing mechanism comprises a pair of parallel power-driven rollers, cones, jaws or impact members with a preselected, preferably adjustable spacing between them. As the excavated material passes between the rollers, the fine material fails through the space between the rollers and the larger material is crushed into finer material by the rollers. Alternatively, the fine material may be removed by a screen mechanism before the larger material is placed in the crushing mechanism.

A crusher according to this invention may be installed on padding machines of the type described in the patents listed above. It may be attached to the end of the transverse conveyor, operably located over the trench. Alternatively, the crusher may be positioned on the machine frame, and the output from the crusher may be conveyed to the trench by the transverse conveyor or other means. The crusher may replace the screens used on padding machines shown in the prior art, or it may supplement those screens. It may be desirable to place a sifting or sorting mechanism upstream of the crusher to keep boulders and other undesirable materials from reaching the crusher. It may also be desirable to remove fines from the excavated material before it is fed into the crusher, to avoid choking or clogging the crushing mechanism.

The present invention therefore provides an improved machine which allows efficient production of padding material from excavated material during installation or maintenance of a pipeline or buried cable, particularly where conventional screening means are not adequate. The crushing mechanism of the present invention eliminates reliance on the presence of an adequate supply of separable fine material for padding in the raw excavated material. These and other advantages of the present invention will be further appreciated from the drawings and from the detailed description provided below.

BRIEF DESCRIPTION OF THE DRAWINGS

So that the manner in which the herein described advantages and features of the present invention, as well as others which will become apparent, are attained and can be understood in detail, more particular description of the invention summarized above may be had by reference to the embodiment thereof which is illustrated in the appended drawings, which drawings form a part of this specification.

It is to be noted, however, that the appended drawings illustrate only exemplary embodiments of the invention and are therefore not to be considered limiting of its scope, for the invention may admit to other equally effective embodiments.

DESCRIPTION OF PREFERRED EMBODIMENTS

Figure 1A:
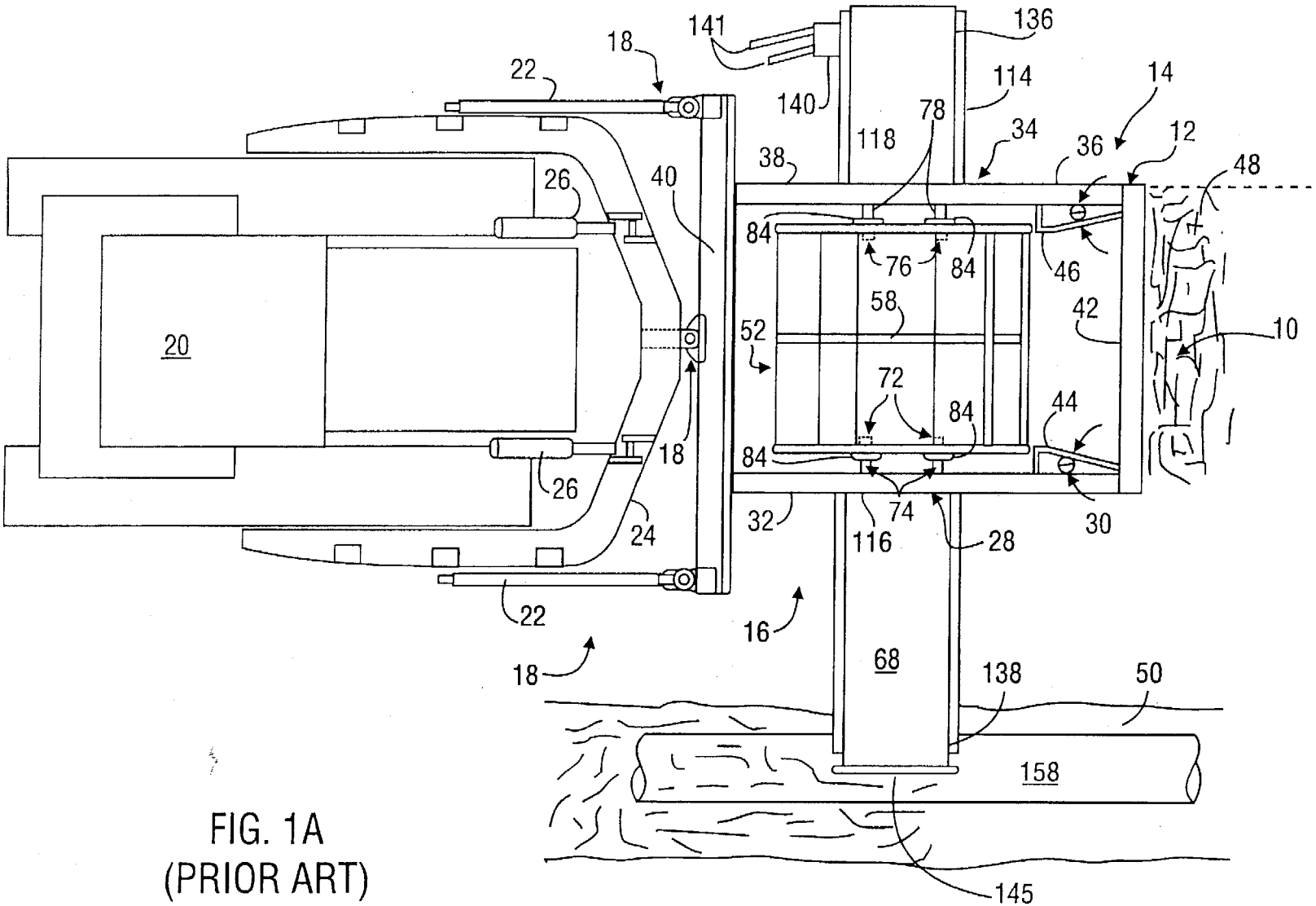
FIG. 1A (PRIOR ART)
FIG. 1A shows that prior art pipeline padding machine with which the present invention may be used.
Figure 1B:
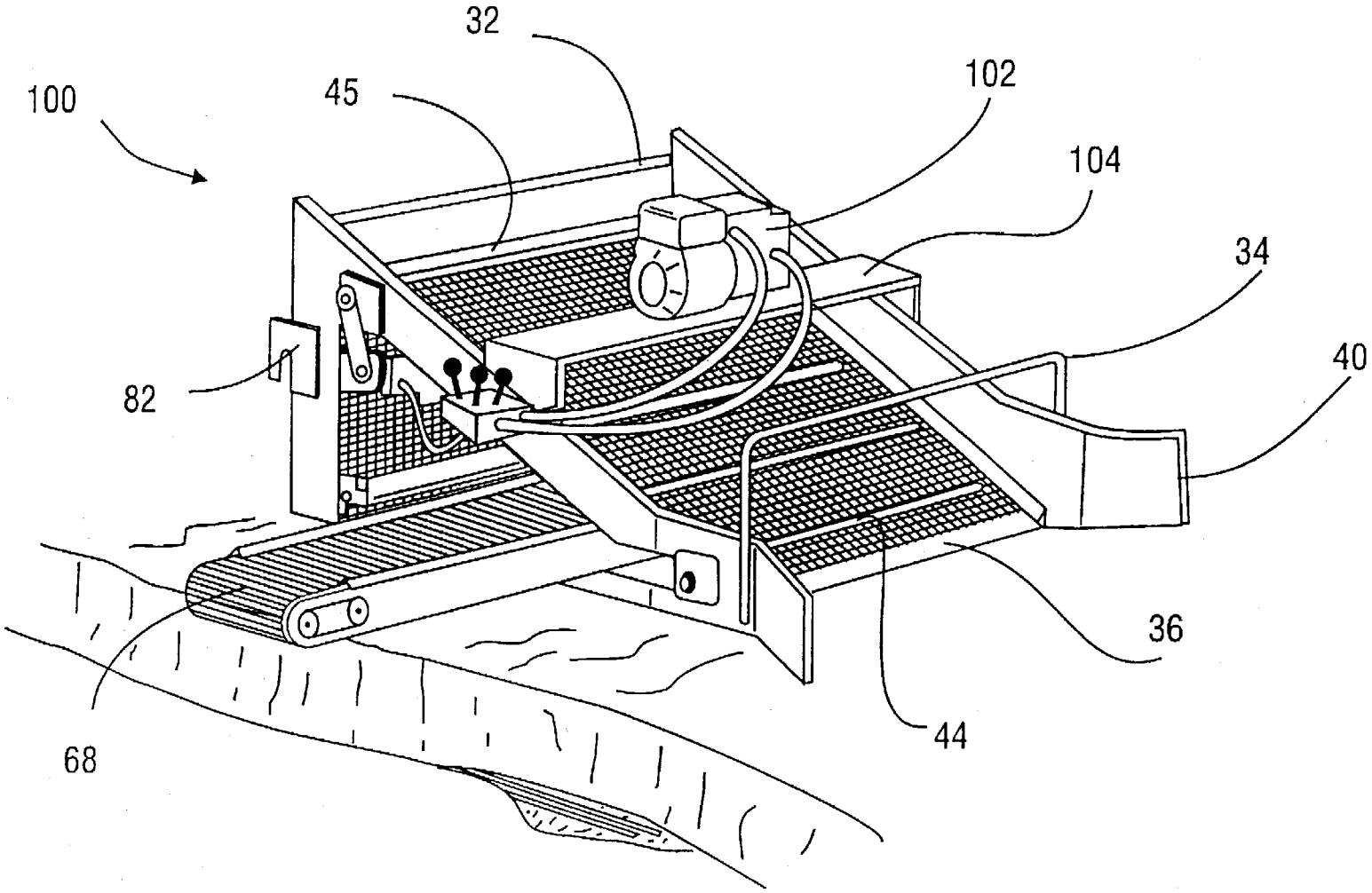
FIG. 1B (PRIOR ART)
FIG. 1B shows a different type of prior art pipeline padding machine with which the present invention may be used.

In its presently preferred embodiment, the present invention is an improvement to an "E-Z Pipe Paddler" padding machine, as described in U.S. Pat. No. 5,084,991, which is incorporated herein by reference. An illustration from the '991 patent is reproduced as FIG. 1 of the present patent. Referring to FIG. 1, the "E-Z Pipe Paddler" is attached to the yoke 24 of bulldozer 20, which during operation supports the padding machine and moves it along the elongated pile of excavated material 48 that is alongside and parallel to trench 50 containing pipe 158. The machine operates by rotating drum 52 around a horizontal axis transverse to the trench in a manner to engage and lift the excavated material. When the excavated material reaches the top of the drum, it falls from the scoops onto bars and/or screens which are arranged around the periphery of the drum. Relatively fine material falls through spaces in the bars/screens and is received by transverse conveyor 68 for deposit into trench 50. Boulders and other objects that are too large to pass through the screens or bars are carried over the top of the drum as it rotates and deposited back on the ground behind the padding machine.

The present invention comprises a crushing mechanism that is mounted, in preferred embodiments, at the distal end of lateral conveyor 68. It is not necessary to place screens around the periphery of drum 52, so that only bars having relatively larger spaces between them are used to remove boulders and large rocks. (Of course, screens may be used to reduce the size of the material collected, if desired.) The remaining material, which includes rocks and clumps of material that are larger than is acceptable for padding material, falls through the bars and onto lateral conveyor 68.

Figure 2:
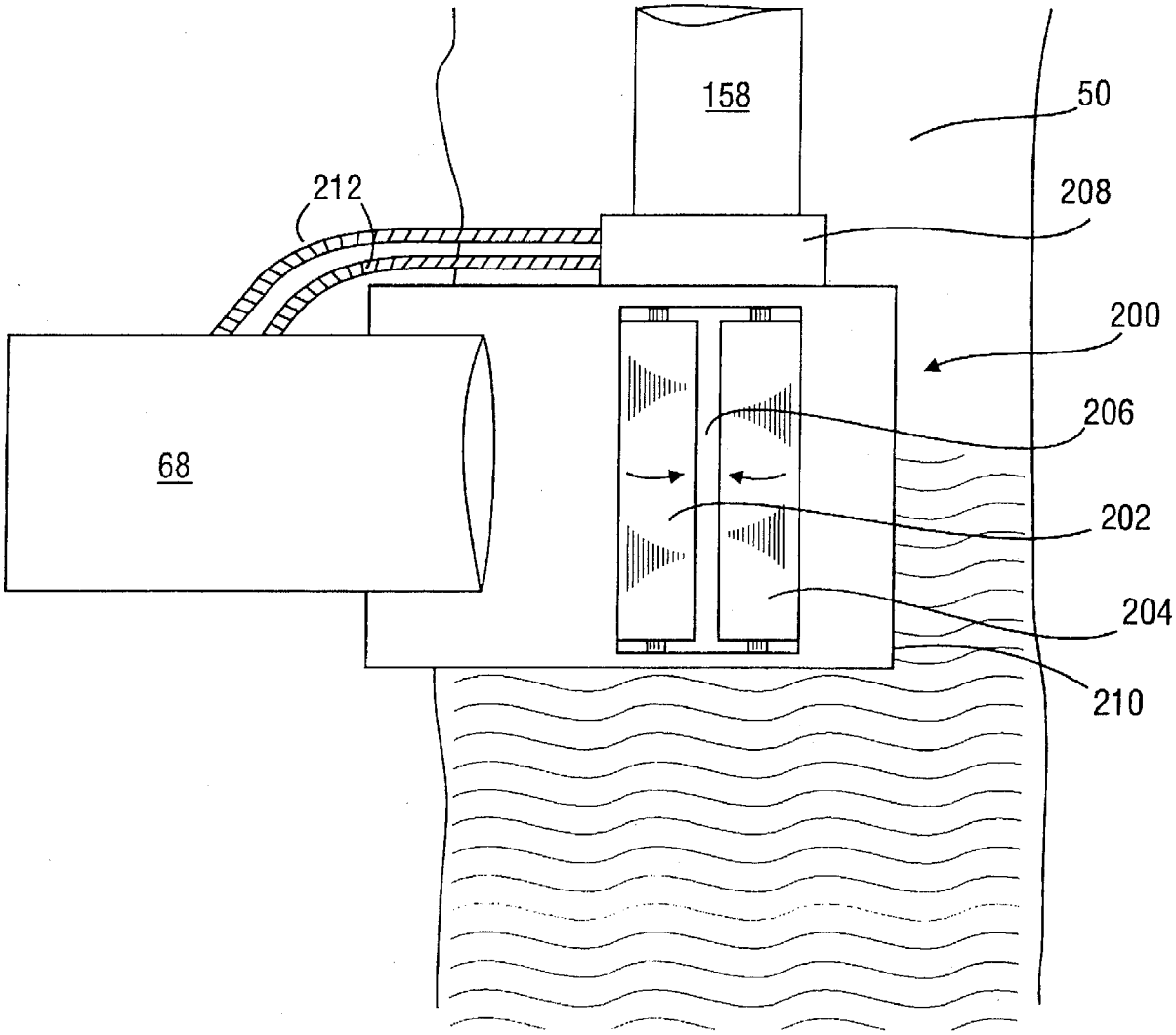
FIG. 2 shows a plan view of a padding crusher according to the present invention operatively coupled to a transverse conveyor from a padding machine and disposed over a pipeline trench.

Referring to FIG. 2, in a preferred embodiment crusher 200 is mounted at the discharge end of conveyor 68. (On some padding machines, the discharge conveyor is adjustable to discharge padding material to either side of the padding machine. A crusher according to this invention could be selectably mounted on either end of the transverse conveyor.) One embodiment of crusher 200 comprises a pair of parallel rollers 202, 204 having a variable gap 206 between them. The rollers 202, 204 are rotated toward one another by motor 208. The dirt and rocks that are deposited onto lateral conveyor 68 by drum 52 are discharged from conveyor 68 into crusher 200, and more particularly into hopper 210. As rollers 202, 204 turn toward one another they draw dirt and rocks from hopper 210 through gap 206 between the rollers, crushing any pieces that are larger than the gap dimension into material that is suitably fine for use as padding material. In this embodiment, the padding material falls from gap 206 between rollers 202, 204 into trench 50. Rollers 202, 204 may be driven by hydraulic motors 208. Other types of motors, such as electric or gasoline motors may alternatively be employed to power the crusher. Suitable gearing mechanisms and other power transfer apparatus may be incorporated as needed. A skilled engineer with the benefit of this disclosure could design a suitable drive means for the crusher, guided by the speed, torque and power requirements of the particular implementation. Hydraulic motor 208 may be powered by pressurized hydraulic fluid supplied from the padding machine or from the host vehicle through hydraulic lines 212. The outer surfaces of rollers 202, 204 may be textured, as for example with small weld deposits, to more efficiently draw dirt and rocks from hopper 210 and through gap 206 between rollers 202, 204.

The suitable size, type and number of rollers may depend on the particular characteristics of the material being crushed as well as the desired characteristics of the desired padding material. It is believed that any suitable alloy material such as alloy steel which has been adequately hardened may be used for rollers 202, 204. While two rollers are shown, it is believed that multiple, progressive pairs of rollers may be used.

Crusher 200 according to this invention may be used with equal beneficial effect at the end of the lateral or transverse conveyor on other types of padding machines, such as those described in U.S. Pat. Nos. 4,948,299, 4,633,602, 4,912,862, 5,120,433, 5,097,610 and 5,261,171, all of which are incorporated herein by reference.

Figure 3:
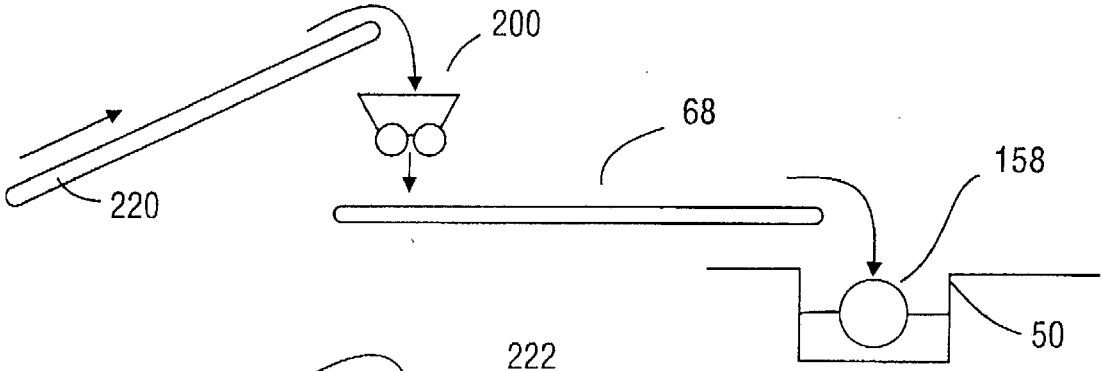
FIG. 3 is a schematic illustration of an arrangement of conveyors and a crusher according to this invention.
Figure 4:
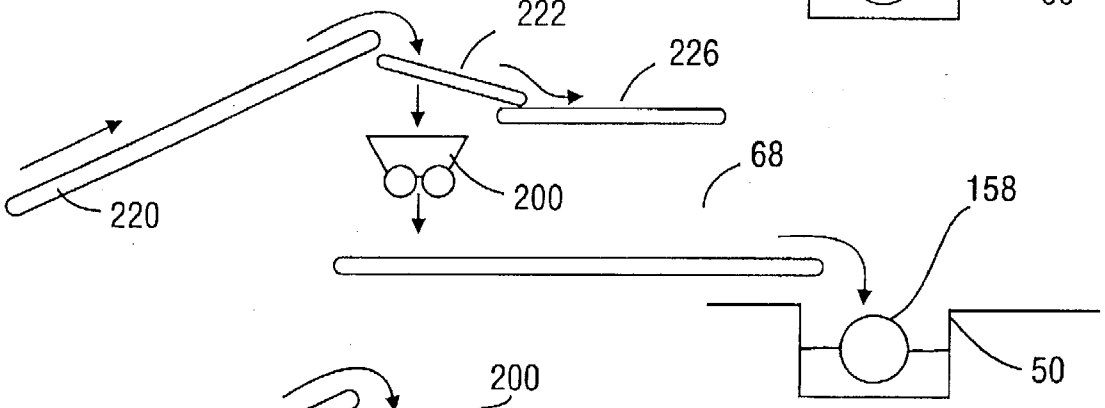
FIG. 4 is a schematic illustration of an alternative arrangement of conveyors and a crusher according to this invention, including a screen disposed upstream from the crusher.
Figure 5:
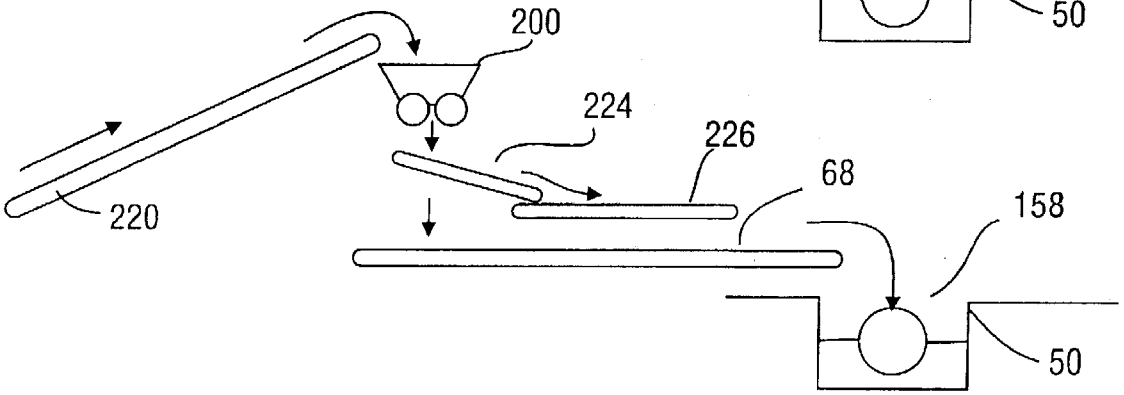
FIG. 5 is a schematic illustration of yet another alternative arrangement of conveyors and a crusher according to this invention including a screen disposed downstream from the crusher.

FIGS. 3 through 5 illustrate alternative configurations in which the crusher 200 of this invention may be utilized. FIG. 3 shows crusher 200 relocated from the distal end of transverse conveyor 68 to the proximal end of transverse conveyor 68, crushing the excavated material prior to depositing it on transverse conveyor 68. In this embodiment, excavated material is raised from ground level by conveyor 220 and deposited into crusher 200. The crushed material is deposited on transverse conveyor 68 which conveys it to trench 50 for placement over pipe 158. In the type of padding machine illustrated and described in U.S. Pat. No. 5,084,991, which is incorporated herein by reference, the crusher may be positioned inside of the rotating drum to receive excavated material that is lifted by the drum and to crush that material before it is deposited onto the transverse conveyor for placement in the ditch or trench.

FIG. 4 shows a schematic representation of another embodiment wherein excavated material is carried by conveying means 220 and deposited on screen 222. Screen 222 separates material into relatively fine material that passes through screen 222 and into crusher 200, and relatively course material that is too large to pass through screen 222. The course material is deposited on waste conveyor 226 and placed at a desired location. The material which enters crusher 200 is crushed and deposited on conveyor 68 which carries it to trench 50 for placement over pipe 158. An additional screen and conveyor or chute may be employed to separate fine material and bypass it around the crusher, so as to avoid overloading the crusher with fine material.

FIG. 5 shows yet another embodiment in schematic form. Conveyor 220 carries excavated material and deposits it into crusher 200. The crushed material is subsequently screened by screen 224. The fine material which falls through the screen is placed on transverse conveyor 68 for placement in trench 50. The courser material which does not pass through screen 224 is deposited on conveyor 226 for placement as desired, which may be in trench 50 after the fine material has been placed over the pipe, onto the ground adjacent trench 50 or returned to crusher 200 for reprocessing.

Figure 6:
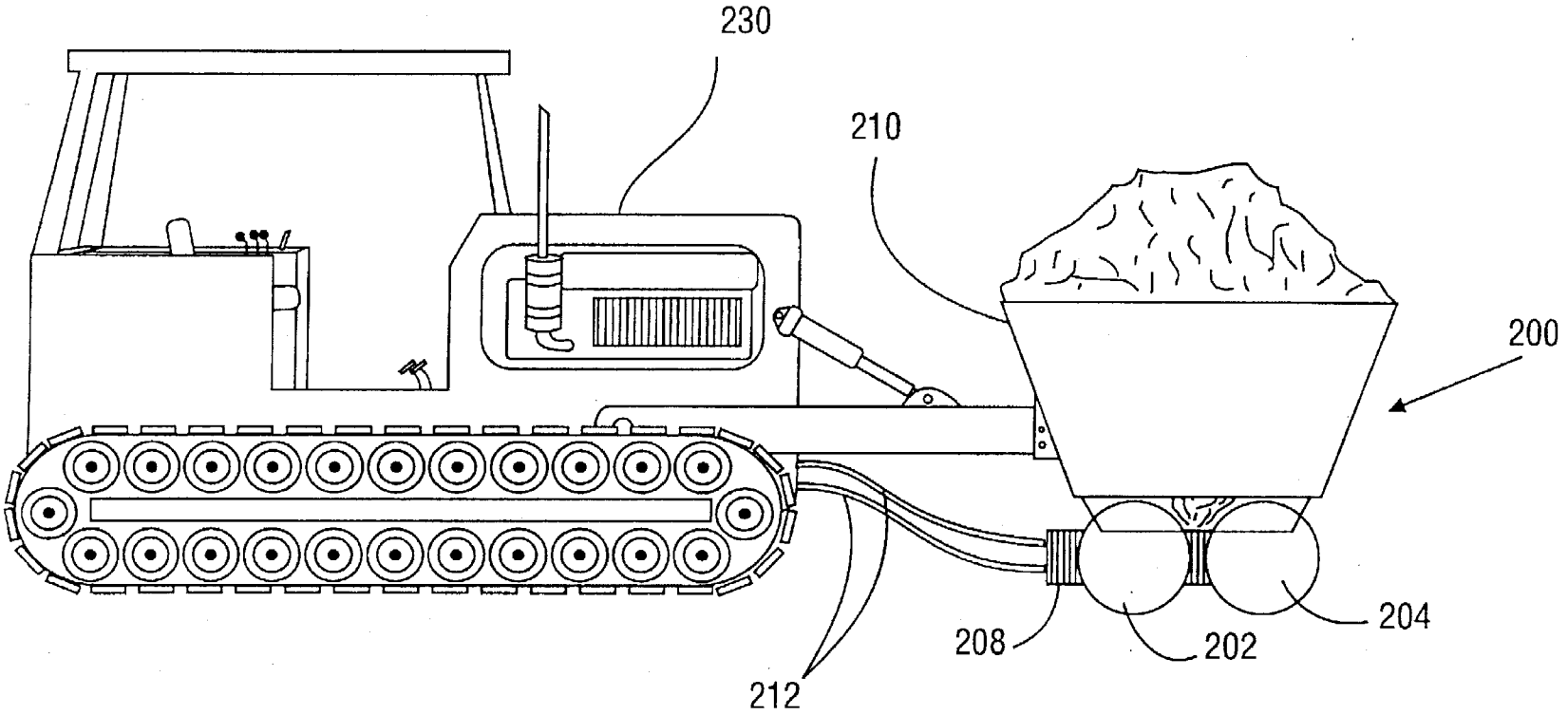
FIG. 6 illustrates a crushing mechanism according to the present invention mounted on a vehicle that is not a padding machine.

FIG. 6 shows yet another embodiment of the present invention. Crusher 200 may be mounted on bulldozer 230 or other vehicle, or it may be mounted on a stand or skid. A hopper 210 may be provided for receiving a supply of excavated material to be crushed and placed in a pipeline trench. As in the previously described embodiment, crushing rollers 202 and 204 are driven by hydraulic motor 208, utilizing power delivered through hydraulic lines 212 from the bulldozer. The hopper may be filled by a front-end loader or other means, and then positioned over the pipeline trench. The operator may then activate hydraulic motor 208 to cause rollers 202, 204 to deposit crushed padding material into the trench. Such a crusher mechanism may be used on other types of equipment as well. For example, a front-end loader could be equipped with a crushing mechanism attached to a bucket. The bucket could be used to pick up excavated material from the ground, and then the crusher operated to deposit crushed material into the trench.

A crusher according to this invention may also be used in conjunction with a ditching or trenching machine. All or a portion of the rock and soil excavated to dig the trench may be crushed and returned to the ground along the right-of-way. The crushed material may than be gathered and screened by a conventional padding machine and the resulting padding material may be deposited in the trench to surround the pipe or cable that is to be disposed therein. The crusher according to the present invention is well suited for padding operations in areas where the native excavated material does not contain sufficient amounts of suitable material that can be obtained by screening.

Figure 7:
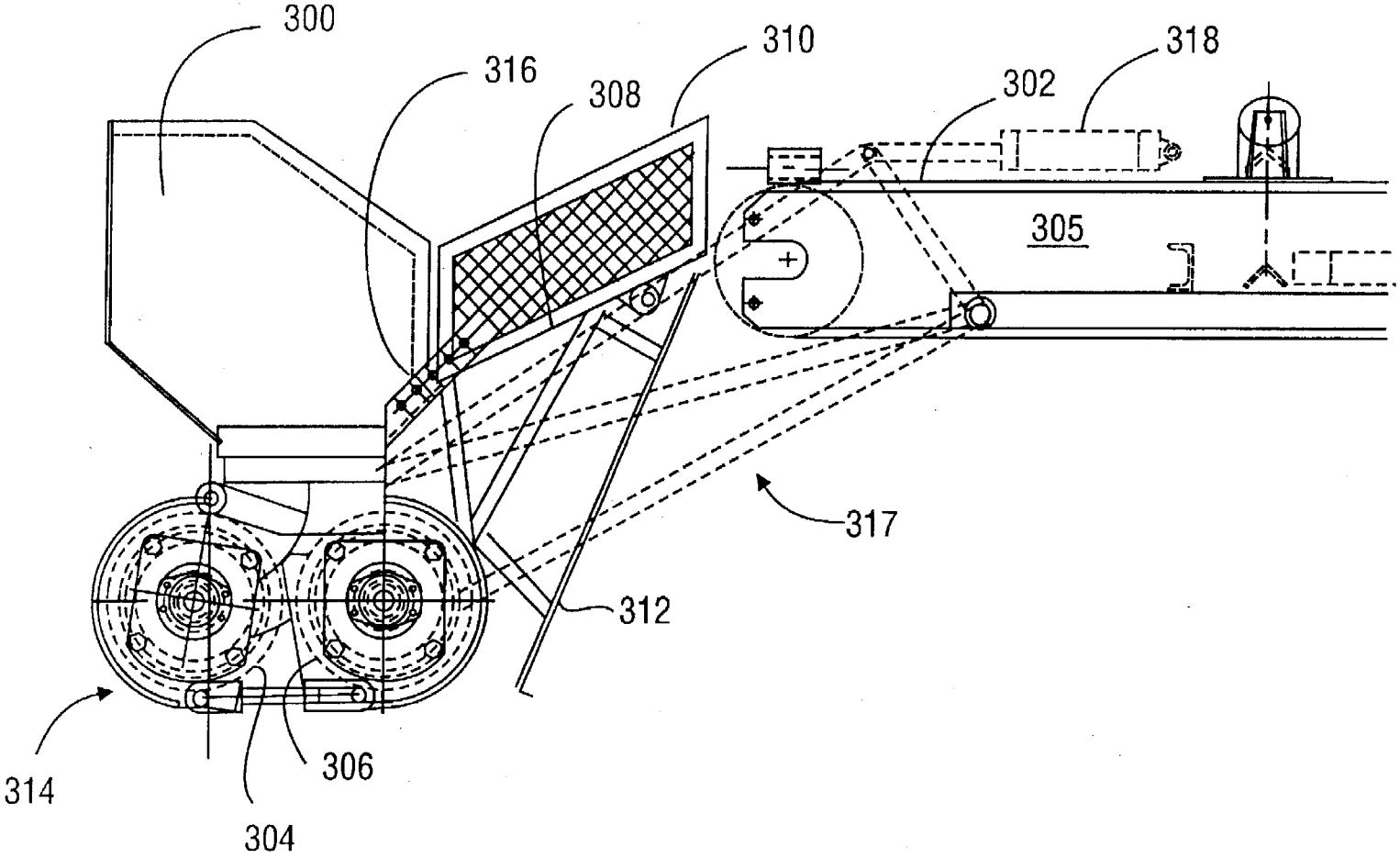
FIG. 7 is an elevation view of a preferred embodiment of a padding crusher mechanism according to the present invention.

FIG. 7 shows a preferred embodiment of a padding crusher according to this invention mounted on the end of a conveyor belt structure that typically extends from a padding machine, as shown in the above listed patents. A padding machine, ditching machine, or other source of excavated material is presumed to be to the right of the structure as shown in FIG. 7. The excavated material is conveyed to the left on conveyor belt 302, which is supported by conveyor supporting structure 304. In the prior art, the material placed on conveyor 302 was suitable padding material that had already been screened, and it was deposited into the trench directly off of the end of conveyor 302. The present invention may be suspended from the end of conveyor supporting structure 305, as illustrated, to receive the material conveyed by conveyor belt 302 and further process it prior to depositing it in the trench.

The crusher according to the embodiment of the present invention shown in FIG. 7 comprises a hopper 300 for receiving excavated material from conveyor 302 and a pair of crushing rollers 306, 304 for receiving material from the hopper 300, crushing any of the material that is too large to fit between the rollers, and depositing the resulting material into the trench.

In the illustrated embodiment, a screen 308 is disposed between the end of conveyor belt 302 and hopper 300. The screen mesh size is selected to permit those pieces of the excavated material that are smaller than a preselected size to pass through the screen and bypass the crusher, while retaining those pieces that are larger than the preselected size and depositing them into hopper 300. Guide walls 310 may be positioned along the sides of screen 308 to retain excavated material on screen 308 and to guide material that is too large to pass through the openings in screen 308 into hopper 300. A shaking or vibrating mechanism may be employed to shake screen 308 during operation. The material that passes through screen 308 is directed into the trench by slide or chute 312, which is supported by suitable structural members below screen 308. The purpose of screen 308 is to reduce the volume of material that is introduced into crushing mechanism 314, in order to avoid overloading or choking crusher 314 and to increase the capacity and speed of the apparatus. With screen 308 in place, only the material that needs to be crushed or broken up is introduced into hopper 300 and fed through crusher 314. Ramp 316 may be positioned between screen 308 and hopper 300 to support the material that passes between those two components. Ramp 316 may include sidewalls to prevent material from falling off of ramp 316 during operation of the padding mechanism.

Crusher mechanism 314, along with hopper 300 and screen 308 may be suspended from conveyor supporting structure 305 by an adjustable frame 317 as shown in FIG. 7. The elevation of crusher 314 above the trench or ground level may be adjusted by operation of hydraulic cylinder 318. The particular arrangement of the supporting structure is not considered part of this invention, and is a matter of design choice in any particular implementation of the invention. In some applications, there may be no need for an adjustable frame, and a fixed frame may be employed.

Figure 8:
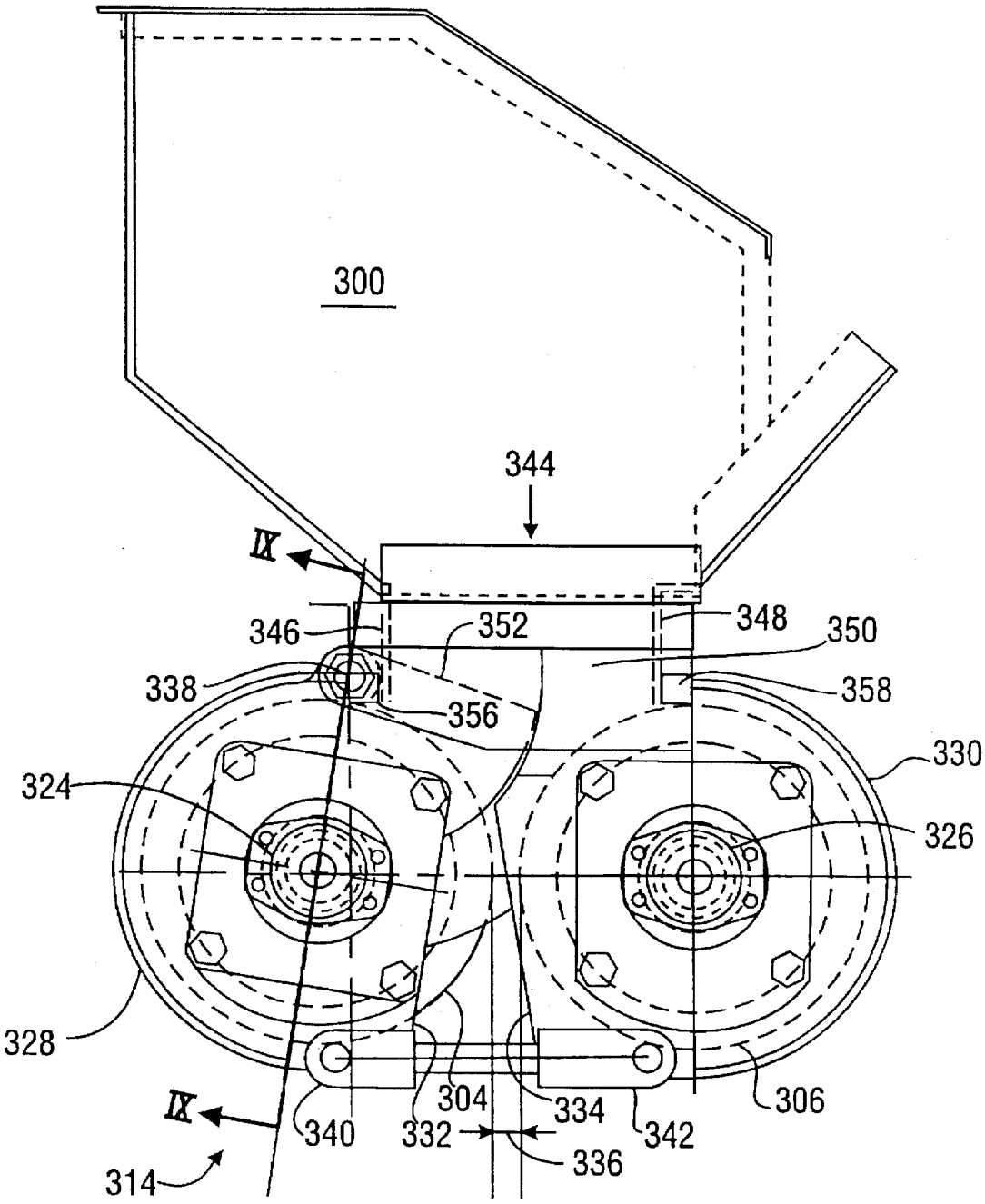
FIG. 8 is an elevation view of a padding crusher according to the present invention, illustrating details of the crushing mechanism.

FIG. 8 illustrates further details of a presently preferred embodiment of crusher mechanism 314 of this invention, complete with hopper 300. Crushing rollers 304, 306 are supported at each end by bearing assemblies 324, 326. Semicylindrical housing members 328, 330 are suspended below hopper 300 and arranged to cover the outwardly facing surfaces of rollers 304, 306. Semicylindrical housing members 328, 330 have end plates 332, 334 attached thereto that at least partially cover the ends of rollers 304, 306. The hopper and housing members may be attached to and supported by a suitable structural frame. Bearing assemblies 324, 326 are attached to and supported by end plates 332, 334.

In the illustrated embodiment of FIG. 8, the right-hand housing member 330 and cylinder 306 are fixed in position with respect to hopper 300 and the frame of crusher 314. The left-hand housing 328 and roller 304 are pivotally movable with respect to the right-hand roller 306, permitting the crush gap 336 between the rollers 304, 306 to be adjusted by the operator of the machine. In a preferred embodiment, the movable left-hand housing member 328 is pivotally mounted to the frame by pivot bolts 338. The width of crush gap 336 may be adjusted and maintained by adjusting eye-bolt 340, which threadably engages socket 342, which is pivotally attached to the stationary position of housing 330. Eye bolt 340 may be disconnected from movable portion of housing 328, and its extension from socket 342 may be adjusted by rotating it around its longitudinal axis. Eye bolt 340 may then be re-attached to the movable portion of housing 328, thus establishing a selected and fixed crush gap 336 between rollers 304, 306. A similar eye bolt and socket arrangement may be positioned at the other end of crusher 314.

Alternatively, the rollers 304, 306 may be spring biased (not shown) toward one another, permitting the rollers to move apart if something hard enough to overcome the spring force without being crushed is drawn between the rollers. In the presently contemplated preferred applications for this invention it is impermissible to allow objects larger than the selected crush gap to fall into the trench, so the crush gap 336 is rigidly fixed rather than being spring biased. A screening apparatus may be placed downstream of a spring biased crusher to prevent oversized material from being placed in the trench, such as in the arrangement shown in FIG. 5.

It is preferable to direct excavated material from hopper 300 onto the "feed zone" of rollers 304, 306 without permitting any dirt or rocks to fall around the outside of crushing rollers 304, 306. The "feed zone" is that portion of the upper surfaces of the rollers proximate the crush gap 336 that is designed to accept material for crushing. Hopper 300 is therefore provided with chute 344 which directs excavated material onto the rollers proximate crush gap 336. Chute 344 has front and rear walls 346, 348 and lateral walls 350. The lateral walls 350 are disposed inwardly spaced from the ends of rollers 304, 306 so as to prevent excavated material from entering the spaces between the ends of rollers 304, 306 and end plates 332, 334. Pivotally movable housing member 328 has a diverter plate 352 affixed thereto which slidably engages lateral wall 350 of chute 344 to direct excavated material into the feed zone on top of rollers 304, 306 and away from the space between roller 304 and moveable end plate 332, regardless of the selected crush gap 336.

It may sometimes be necessary to reverse the direction of rotation of rollers 304 and 306, for example to dislodge a hard object or to clear a clogging or choking condition in crush gap 336. It is therefore desirable to ensure that no oversized excavated material is carried around the back sides of rollers 304 and 306 when they are rotated backwards (away from one another). Guard bars 356, 358 are provided to define the front and rear limits of the feed area. They extend the length of rollers 304, 306 between end plates 332, 334 on each side of the machine. Guard bars 356, 358 are positioned closely spaced from the outer surfaces of rollers 304, 306 so that no oversized material can pass between guard bars 356, 358 and rollers 304, 306.

Figure 9:
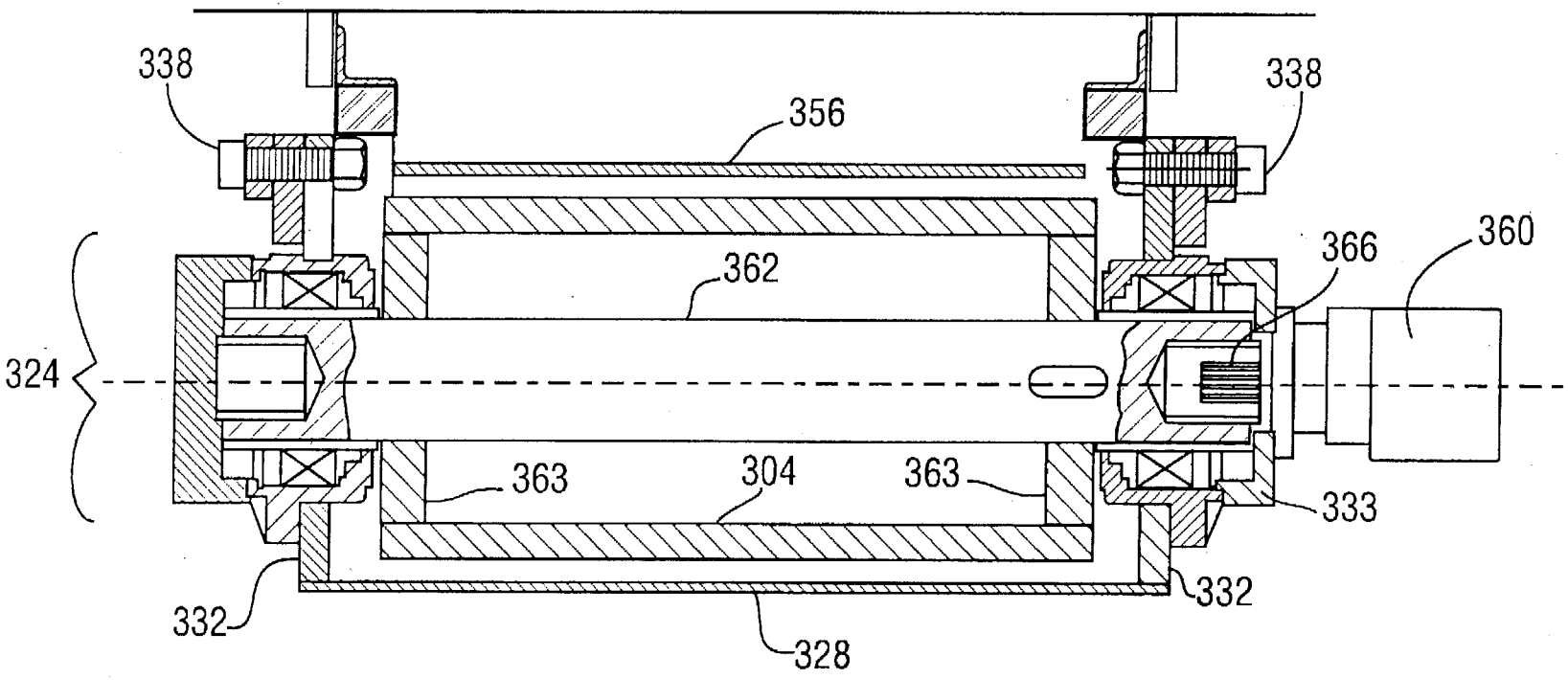
FIG. 9 is a cross-sectional view of a crushing roller assembly and supporting structure according to a preferred embodiment of the present invention.

FIG. 9 shows a front elevation cross section of a presently preferred embodiment of the present invention. (Section IX—IX in FIG. 8). Axle 362 is supported by bearing assemblies 324 at each end. Hydraulic motor 360 is mounted on mounting plate 333 and operatively coupled to axle 362. One hydraulic motor is provided for each of the two rollers 304, 306. The two hydraulic motors 360 may be hydraulically arranged in series or in parallel, depending on the power requirements of the application. If necessary, motors can be placed at both ends of each roller. The specific construction of the bearing assemblies, e.g., 324, will be recognized by those of skill in the art as a matter of design choice to accommodate the anticipated load, considering the desired speed, torque and crushing force. The present invention is not intended to be limited to particular drive and bearing arrangements. Also, different sorts of crusher mechanisms may be used in implementing this invention. For example and without limitation, apparatus including cone crushers, jaw crushers, and impact hammers may be employed in place of or in conjunction with the roller crusher described in connection with the presently preferred embodiments of the invention.

Rollers 304, 306 may be sections of heavy walled tube. Roller end plates 363 are connected to the ends of roller 304, preferably by welding and then keyed to axle 362. When hydraulic motor 360 is operated, it transmits power to the axle via coupling 366, which causes the roller to turn. Hydraulic power may be provided from an external hydraulic power unit, which may be mounted on the padding machine to which the crusher of this invention is attached. The crusher is operated by hydraulic or electrical controls that are positioned within reach of the padding machine operator. The elevation of the crusher above the trench may be controlled by manipulation of valves that provide hydraulic power to cylinder 318, which is shown in FIG. 7. The direction and speed of rotation of crushing rollers 304, 306 may be controlled by manipulation of valves that provide hydraulic power to hydraulic motors 360, which are operably coupled to rollers 304, 306.

Further modifications and alternative embodiments of this invention will be apparent to those skilled in the art in view of this description. Accordingly, this description is to be construed as illustrative only and is for the purpose of teaching those skilled in the art the manner of carrying out the invention. It is to be understood that the forms of the invention herein shown and described are to be taken as the presently preferred embodiments. Various changes may be made in the shape, size, and arrangement of parts. For example, equivalent elements or materials may be substituted for those illustrated and described herein, and certain features of the invention may be utilized independently of the use of other features, all as would be apparent to one skilled in the art after having the benefit of this description of the invention.

We claim:

1. A pipeline padding system for processing at least a portion of the excavated material into a final processed padding material, the excavated material positioned along the side of a ditch in which a pipeline has been laid, the system having:

a pipeline padding machine, including:

a means for engaging the excavated material and elevating a portion of said excavated material to a first position located on said machine;

a separator for separating the elevated excavated material into a coarse portion and a padding portion, said coarse portion deposited away from the open ditch;

a crusher assembly mounted on said padding machine for receiving substantially all of said padding portion of said elevated excavated material and crushing said padding portion into said final processed padding material having a maximum predetermined size without further processing of said final processed padding material.

2. The padding system of claim 1, wherein the padding machine includes a transverse conveyor for conveying the padding portion to a location lateral to the padding machine, and wherein the crusher assembly is located at a distal end of the transverse conveyor to receive the padding portion from the transverse conveyor.

3. The padding machine of claim 1, wherein the crusher assembly is selectively adjustable to alter the maximum predetermined size.

4. A pipeline padding system for processing at least a portion of the excavated material into a final processed padding material, the excavated material positioned along the side of an open ditch in which a pipeline has been laid, the system having:

a pipeline padding machine, including:

a means for engaging the excavated material and elevating a portion of said excavated material to a first position located on said machine;

a separator for receiving and separating the elevated excavated material into a coarse portion and a padding portion, said coarse portion deposited away from the open ditch;

a crusher assembly mounted on said padding machine for receiving at least a portion of said padding portion of said elevated excavated material and crushing said at least a portion of said padding portion into said final processed padding material having a maximum predetermined size, said crusher assembly having a pair of crushing rollers that are spaced from one another, the rollers rotatable about their longitudinal axis toward one another such that the material which is received by the crusher assembly is dram between the rollers and crushed, said final processed padding material being deposited into said open ditch about the pipeline without further processing.

5. The padding system of claim 4, wherein the padding machine includes a transverse conveyor for conveying said at least a portion of the padding portion to a location lateral to the padding machine, and wherein the crusher assembly is located at a distal end of the transverse conveyor to receive said at least a portion of the padding portion from the transverse conveyor.

6. The padding machine of claim 4, wherein the crusher assembly is selectively adjustable to alter the maximum predetermined size.

7. The padding system of claim 4, wherein the rollers have textured outer surfaces adapted to engage the material that is deposited into the crusher and to pull that material downwardly between the rollers.

8. A pipeline padding system for processing at least a portion of the excavated material into a final processed padding material, the excavated material positioned along the side of an open ditch in which a pipeline has been laid, the system comprising:

a pipeline padding machine having:

a means for receiving a portion of said excavated material at a first position located on said machine;

a separator for separating the received excavated material into a coarse portion and a padding portion, said coarse portion deposited away from the open ditch;

a crusher assembly mounted on said padding machine for receiving at least a portion of said padding portion of said received excavated material and crushing said at least a portion of said padding portion into said final processed padding material having a maximum predetermined size without further processing of said final processed padding material.

9. The padding system of claim 8, wherein the padding machine includes a transverse conveyor for conveying said at least a portion of the padding portion to a location lateral to the padding machine, and wherein the crusher assembly is located at a distal end of the transverse conveyor to receive the material from the transverse conveyor.

10. The padding machine of claim 8, wherein the crusher assembly is selectively adjustable to alter the maximum predetermined size.

* * * * *

UNITED STATES PATENT AND TRADEMARK OFFICE

CERTIFICATE OF CORRECTION

| | | |
|---|---|---|
| PATENT NO. | : | 5,694,709 |
| DATED | : | December 9, 1997 |
| INVENTOR(S) | : | Thomas J. Cronk, Jr. and Ray E. Hudson |

It is certified that error appears in the above-identified patent and that said Letters Patent is hereby corrected as shown below:

In claim 4, column 9, line 45, delete "dram" and insert --drawn-- therefor.

Signed and Sealed this

Twenty-fourth Day of February, 1998

*Attest:*

BRUCE LEHMAN

*Attesting Officer*

*Commissioner of Patents and Trademarks*